US011292252B2

(12) United States Patent
Schneider et al.

(10) Patent No.: US 11,292,252 B2
(45) Date of Patent: Apr. 5, 2022

(54) METHOD AND DEVICE FOR SYNCHRONIZING A FIRST PRINTING DEVICE WITH A SECOND PRINTING DEVICE

(71) Applicant: Canon Production Printing Holding B.V., Venlo (NL)

(72) Inventors: Claus Schneider, Eching (DE); Ulrich Stoeckle, Munich (DE)

(73) Assignee: Canon Production Printing Holding B.V., Venlo (NL)

( * ) Notice: Subject to any disclaimer, the term of this patent is extended or adjusted under 35 U.S.C. 154(b) by 0 days.

(21) Appl. No.: 17/065,824

(22) Filed: Oct. 8, 2020

(65) Prior Publication Data

US 2021/0107280 A1 Apr. 15, 2021

(30) Foreign Application Priority Data

Oct. 10, 2019 (DE) ..... 102019127277.7

(51) Int. Cl.
*B41J 2/045* (2006.01)

(52) U.S. Cl.
CPC ..... *B41J 2/04586* (2013.01); *B41J 2/04558* (2013.01)

(58) Field of Classification Search
CPC ..... B41J 2/04586; B41J 2/04558; B41J 11/0095; B41J 11/46; B41J 11/008
See application file for complete search history.

(56) References Cited

U.S. PATENT DOCUMENTS

| | | | | |
|---|---|---|---|---|
| 9,302,474 | B2 | 4/2016 | Koerner et al. | |
| 10,168,637 | B2 * | 1/2019 | Iwata | G03G 15/043 |
| 11,087,438 | B2 * | 8/2021 | Schmidt | G06T 3/4038 |
| 2015/0116736 | A1 | 4/2015 | Howard et al. | |

FOREIGN PATENT DOCUMENTS

| | | | |
|---|---|---|---|
| DE | 102014106424 | A1 | 11/2015 |
| JP | 2002249276 | A | 9/2002 |

OTHER PUBLICATIONS

German action dated Mar. 26, 2020, Application No. 10 2019 127 277.7.

* cited by examiner

*Primary Examiner* — Lamson D Nguyen
(74) *Attorney, Agent, or Firm* — Schiff Hardin LLP

(57) ABSTRACT

In a method and a device for synchronizing a first printing device with a second component (e.g. second printing device), based on a property of a print image printed by the first printing device, which the property is detected by an optical sensor, a first print image is printed and at least one part of the first print image is detected using the optical sensor to generate a corresponding sensor signal. A virtual sensor signal is determined based on first print data and a known position of the optical sensor. The virtual sensor signal is compared with a curve of the sensor signal and a position signal is generated based on the result of the comparison. A second component is started depending on the position signal.

15 Claims, 3 Drawing Sheets

METHOD AND DEVICE FOR SYNCHRONIZING A FIRST PRINTING DEVICE WITH A SECOND PRINTING DEVICE

CROSS REFERENCE TO RELATED APPLICATIONS

This patent application claims priority to German Patent Application No. 102019127277.7, filed Oct. 10, 2019, which is incorporated herein by reference in its entirety.

BACKGROUND

Field

The disclosure relates to a method and a device for synchronizing a plurality of printing devices with the aid of a property of a print image printed by a first printing device, said property being detected by an optical sensor.

Related Art

Given the printing of a plurality of print images on a recording medium by a plurality of independent printing devices, the position of the print images on the recording medium in the printing direction must be determined in order to correctly set the spacing [pitch] of the individual print images relative to one another and/or to correctly set the registration accuracy of the print images. In particular, for the subsequent printing of a second print image on a back side of the recording medium with the aid of a second printing device after a first print image has been printed on the front side of the recording medium with the aid of a first printing device, the printing processes of the two printing devices must be synchronized with one another and the position of the first print image must be determined relative to the second printing device before the printing of the second print image. For this purpose, in the prior art achievements are known in which the synchronization of two printing devices is ensured with the aid of position markings printed next to the print images, at the edge of the printable width of the recording medium, and detected by an optical sensor. Optical properties of the markings are detected with the aid of the optical sensor; in particular, contrast or brightness differences between the markings and the recording medium are detected by the optical sensor. Upon detecting a marking, a position signal is generated, and the printing of the second print image is started by the second printing device depending on the position signal.

However, the usage of markings leads to a reduction of the width of the recording medium that is usable for the print images, since a separate region at the edge of the printable width of the recording medium, in which region the print image may not be printed, is associated with the markings. The printing of markings additionally increases the toner consumption.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
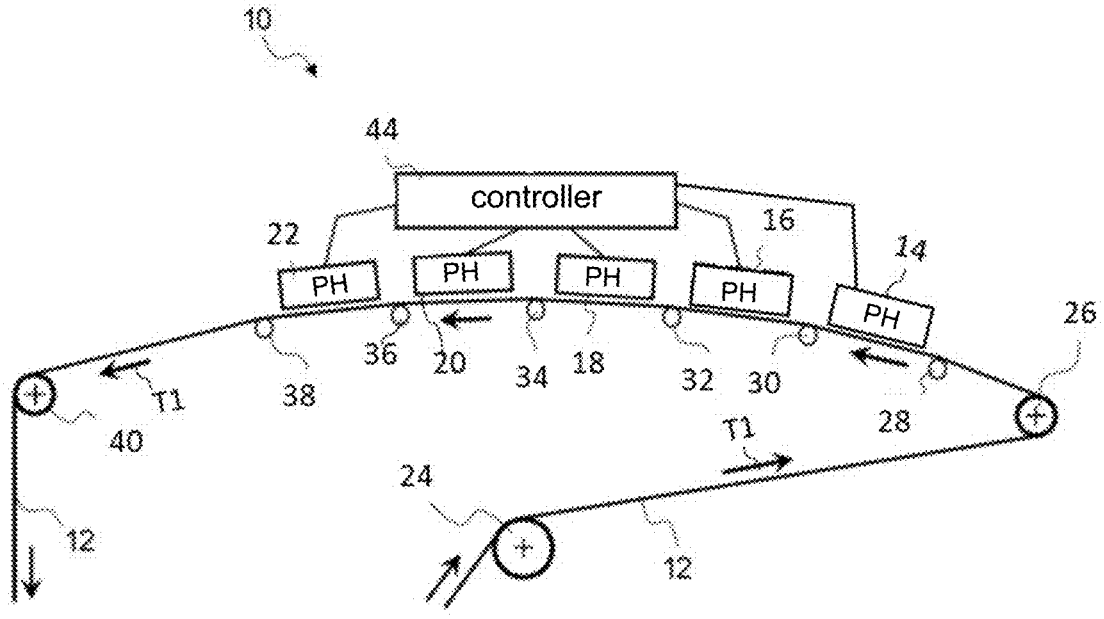
FIG. 1 illustrates an example printing device.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the disclosure is to provide a method and a device for synchronizing the generation of print images on a recording medium by a plurality of printing devices.

In an exemplary embodiment, starting from first print data, a first print image is printed by a first printing device. With the aid of an optical sensor arranged at a known position transverse to a printing direction, a property of the print image, in particular the brightness of the print image, may be detected in the detection region of the sensor with the aid of said sensor, and a corresponding actual sensor signal may be determined. The first print image is continuously recorded with the aid of the optical sensor in a region along the length of the recording medium, and a corresponding curve of the sensor signal is determined.

Furthermore, a virtual sensor signal is determined based on the first print data of the first print image printed on the recording medium. This virtual sensor signal is determined from the known position of the optical sensor and the corresponding region of the print image detected by the optical sensor. The curve of the sensor signal is preferably determined, in particular the curve of the brightness values of the print image in the detected region.

The curve of the actual sensor signal is subsequently compared with the curve of the virtual sensor signal, and given an agreement of the signals a position signal is generated. Depending on the position signal and a length of the recording medium between the optical sensor and a second component, said second component is started.

In an exemplary embodiment, the second component is a second printing device that prints a second print image onto the recording medium. In particular, the second print image is printed onto the back side of the recording medium.

In an exemplary embodiment, by using properties of the print image for position determination, it is possible to use the entire printable width of the recording medium for print images. Moreover, a high print quality is ensured by minimizing the deviation of the print image position on the recording medium given printing with a plurality of successive printing devices.

In an exemplary embodiment, in addition to the synchronization of the first and second printing device, the position of the optical sensor transverse to the printing direction may be determined with the aid of a configuration print image printed on the recording medium. The configuration print image has one or more print objects that are printed across the width of the recording medium. The position of the optical sensor transverse to the printing direction is determined via detection, as a sensor signal, of properties of the print objects in the region of the configuration print image recorded by the optical sensor, and the comparison of the sensor signal with the print data of the configuration print image.

FIG. 1 shows a schematic side view of a printing device 10 for printing to a recording medium 12 in the form of a web. In the exemplary embodiment, the printing device 12 is executed as a known inkjet printing device. Such a printing device is known from the document DE 10 2014 106 424 A1, for example.

In an exemplary embodiment, the printing device 10 has at least one print bar 16 to 22 per primary color, which at least one print bar is arranged transverse to a transport direction T1 of the continuously drivable recording medium 12 in the form of a web. The transport direction T1 therewith also corresponds to a printing direction T1. The recording medium 12 may be produced from paper, paperboard, cardboard, textile, a combination thereof, and/or other materials that are suitable and can be printed to.

As an alternative to continuously supplied recording media 12 in the form of a web, recording media in the form of sheets may also be supplied to the printing device 10 for printing. Furthermore, the printing device 10 may alternatively be designed as an electrographic printing device or as an offset printing device.

The recording medium 12 is directed through the printing device 10, and thereby below and past the print bars 14 to 22 via infeed rollers 24, 26 and a plurality of guide rollers 28 to 38, wherein the print bars 16 to 22 apply a print image 39 onto the recording medium 12 in the form of print dots. Each of the print bars 14 to 22 of the printing device 10 can print the line width.

With the aid of an outfeed roller 40, the recording medium 12 is directed further to a drying (not shown) and, if applicable, to a subsequent second printing device 42 in which in particular a back side of the recording medium 12 may then be printed to. The recording medium 12 may subsequently or alternatively be supplied to a post-processing in which the recording medium 12 is cut, folded, and/or ultimately processed in other work steps.

Four primary colors are typically used for full-color printing, and in fact CMYK (Cyan, Magenta, Yellow, and Black). Additional primary colors, for example green, orange, or violet, may expand the color range of the printing device 10. Moreover, still more colors or special inks may be present, such as Magnetic Ink Character Recognition (MICR) ink (Magnetic Ink Character Recognition=magnetically readable ink). Each primary color is printed with a single print bar 16 to 22 onto the recording medium 12. In an exemplary embodiment, it is likewise possible that transparent special fluids, such as primer or drying promoter, are similarly applied digitally with the aid of a separate print bar, before or after the printing of the print image 39, in order to improve the print quality or the adhesion of the ink on the recording medium 12. In the exemplary embodiment according to FIG. 1, a primer fluid is printed onto the recording medium 12 with the aid of the print bar 14.

With the aid of a controller 44, the individual print bars 16 to 22 are controlled, based on rastered print data, so that individual ink droplets are applied at the position of the recording medium 12 defined by the print data. The individual ink droplets form individual print dots on the recording medium 12, which print dots in their entirety form the print image 39 on the recording medium 12.

Figure 2:
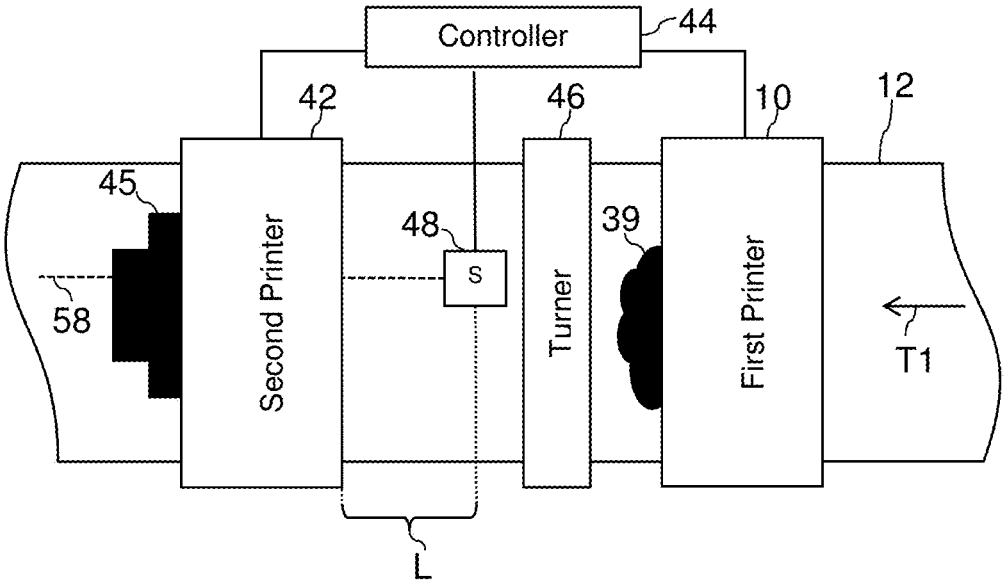
FIG. 2 illustrates a plan view of a first printing device and a second printing device according to an exemplary embodiment.

FIG. 2 shows a schematic plan view of the first printing device 10 and the second printing device 42, which has the same design as the first printing device 10 according to FIG. 1. The print image 39 is printed by the first printing device 10 onto the recording medium 12, and an additional print image 45 is subsequently printed by the second printing device 42 onto the back side of the recording medium 12. With the aid of a turner 46, the recording medium 12 is turned between the first printing device 10 and the second printing device 42 in order to be able to print to the back side of the recording medium from above via the second printing device 42.

With the aid of a drive (not shown), the recording medium 12 is transported in the printing direction T1 through the first printing device 10 and the second printing device 42. In an exemplary embodiment, an optical sensor 48 is arranged below the recording medium 12, downstream of the first printing device 10 in the printing direction T1 or, respectively, downstream of the turner 46 and before the second printing device 42. A region of the print image 39 that was printed onto the front side of the recording medium 12 is detected with the aid of the optical sensor 48. In an exemplary embodiment, the optical sensor 48 includes processor circuitry that is configured to perform one or more functions and/or operations of the optical sensor 48, including detecting the print image 39 and/or one or more properties of the print image, and generating an output signal corresponding to the information detected by the optical sensor 48.

The length L of the recording medium 12 between the optical sensor 48 and the second components (here second printing device 42) is known and stored in the controller 44. The length L of the recording medium 12 may thereby be specified in, for example, steps of a stepper motor of the drive of the recording medium 12. With the aid of the number of steps, it is thereby possible to exactly determine the position of a point on the recording medium 12 in the printing direction T1 between a position of the optical sensor 48 and the second component, here a second printing device 42. The position signal does not only synchronize the first printing device 10 with the second printing device 42. Other second components, such as an image recognition system and/or a post-processor, may use this position signal.

Figure 3:
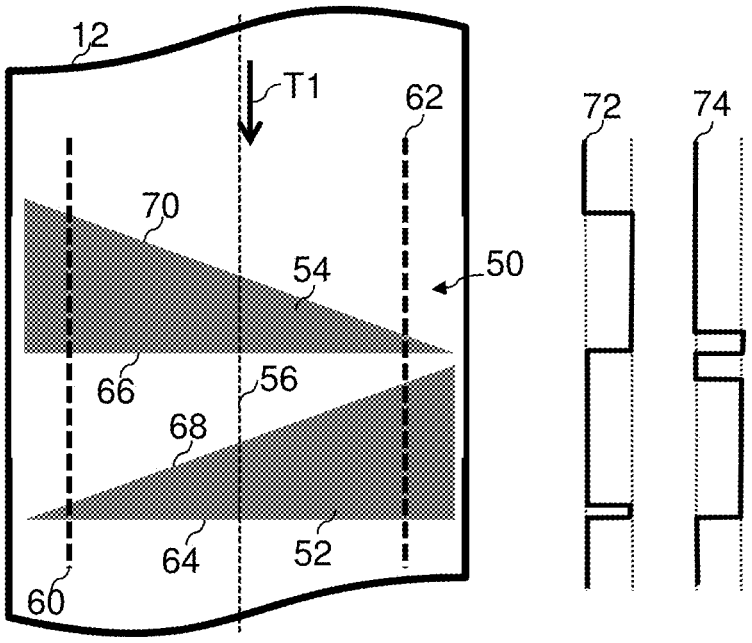
FIG. 3 illustrates a recording medium having a configuration print image printed thereon according to an exemplary embodiment.

FIG. 3 shows a schematic view of a recording medium 12 with a configuration print image 50 printed thereon. The configuration print image 50 is printed onto the recording medium 12 by the first printing device 10. The position of the optical sensor 48 transverse to the printing direction T1 is determined with the aid of the configuration print image 50. The configuration print image 50 has one or more print objects that are printed across the width of the recording medium 12. These print objects may be geometric shapes, for example. The configuration print image 50 preferably has at least one triangle 52, preferably two triangles 52, 54, that are mirrored along the printing direction T1 on an axis 56 in the middle of the recording medium 12 and that are offset relative to one another without intersection along the printing direction T1.

The optical sensor 48 is directed toward the recording medium 12 and, upon forward movement of the recording medium 12 in the printing direction T1, detects a defined region of the recording medium 12 in the printing direction T1 as a track 58, depending on the position of said optical sensor 48. For example, in FIG. 3 two additional tracks 60, 62 of the optical sensor 48 are marked. In the instance in which the optical sensor 48 is arranged at a left side, said optical sensor 48 detects the recording medium 12 along the track 60, for example. In the instance in which the optical sensor 48 is arranged at a right side, said optical sensor 48 detects the recording medium 12 along the track 62, for example.

In an exemplary embodiment, the optical sensor 48 is configured to detect a property of the configuration print image 50. In the exemplary embodiment, the optical sensor 48 is sensitive to brightness and therewith determines the brightness of a region of the recording medium 12 and generates a corresponding sensor signal. If the recording medium 12 with the configuration print image 50 is moved forward in the printing direction T1, a curve of the sensor signal is generated along the track 58 to 62 of the optical sensor 48.

In the exemplary embodiment, the extent of the print objects 52, 54 in the track 58 to 62 of the optical sensor 48 is determined via at least two changes in the brightness of the configuration print image 50. In particular, the optical sensor 48 thereby detects the print objects 52, 54 of the configuration print image 50 between a first side 64 and 66, transverse to the printing direction, and a second side 68 and 70, transverse to the printing direction.

In the exemplary embodiment, the curve of the sensor signal corresponds to the curve of the brightness of the configuration print image 50 printed on the recording medium 12. For the track 58 to 62 of the optical sensor 48, the curve of the sensor signal is thereby generated which may be uniquely associated with this track 58 to 62. For example, for track 60 the signal curve 72 is generated that uniquely differs from the signal curve 74 of track 62.

In the present exemplary embodiment, the controller 44 is designed and configured so that it compares the determined curve of the sensor signal 72 to 76 with the print data of the configuration print image 50. From the print data, the portion of the print data that corresponds to the curve of the sensor signal 72 to 76 is thereby determined as track print data. A position transverse to the printing direction T1 is associated with the curve of the sensor signal 72 to 76 with the aid of the position of the virtual sensor signal within the printable width of the recording medium 12 transverse to the printing direction T1. This position corresponds to the position of the optical sensor 48 transverse to the printing direction T1. The position of the optical sensor 48 is stored in the controller 44.

Alternatively, in other exemplary embodiments the optical sensor 48 may be sensitive to other optical properties of the recording medium 12, for example the color. The optical sensor 48 then determines the color of a region of the recording medium 12 and generates a corresponding sensor signal. The sensor 48 is not limited to an optical sensor and can include one or more additional or alternative sensors as would be understood by one of ordinary skill in the art. In an exemplary embodiment, the optical sensor 48 is a camera, but is not limited thereto.

In a further alternative exemplary embodiment, it is possible to measure the position of the optical sensor 48 transverse to the printing direction T1 and to store said position in the controller 44.

Figure 4:
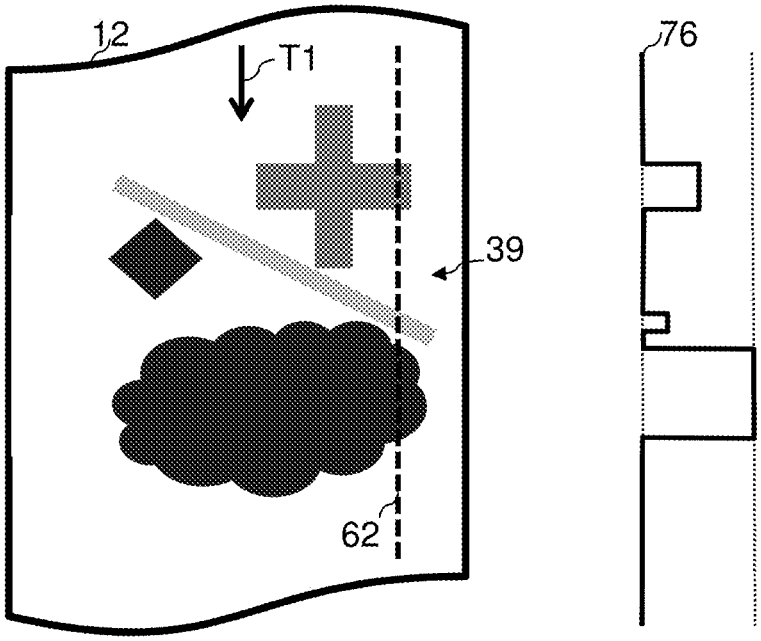
FIG. 4 illustrates a recording medium having a print image printed thereon.

FIG. 4 shows a schematic view of a recording medium 12 with the first print image 39 printed onto the front side of the recording medium 12 with the aid of the first printing device 10. A curve of the sensor signal 76 along the track 62 may be determined with the aid of the optical sensor 48, which is arranged at a known position transverse to the printing direction T1, which position is preferably determined with the aid of the configuration print image 50. The extent of the print objects of the print image 39 is thereby detected as for the configuration print image 50 in FIG. 3. The extent of the print objects is determined via at least two changes in the brightness of the print image 39.

The controller 44 is designed and configured so that it determines a virtual sensor signal from the print data of the print image 39 in the track of the optical sensor 48, said print image 39 being printed onto the recording medium 12, which virtual sensor signal has a curve agreeing with the sensor signal of the optical sensor 48. Moreover, the controller 44 is designed and configured so that it compares the two signal curves and generates a position signal given an agreement. Depending on the position signal and the length L of the recording medium 12 between the optical sensor 48 and the second printing device 42, the controller 44 starts the second component, here the second printing device 42 for printing a second print image 45 onto the recording medium 12. The position signal does not only synchronize the first printing device 10 with the second printing device 42. Other second components, such as an image recognition system and/or a post-processor, may use this position signal. In an exemplary embodiment, the controller 44 includes processor circuitry that is configured to perform one or more functions and/or operations of the controller 44.

Figure 5:
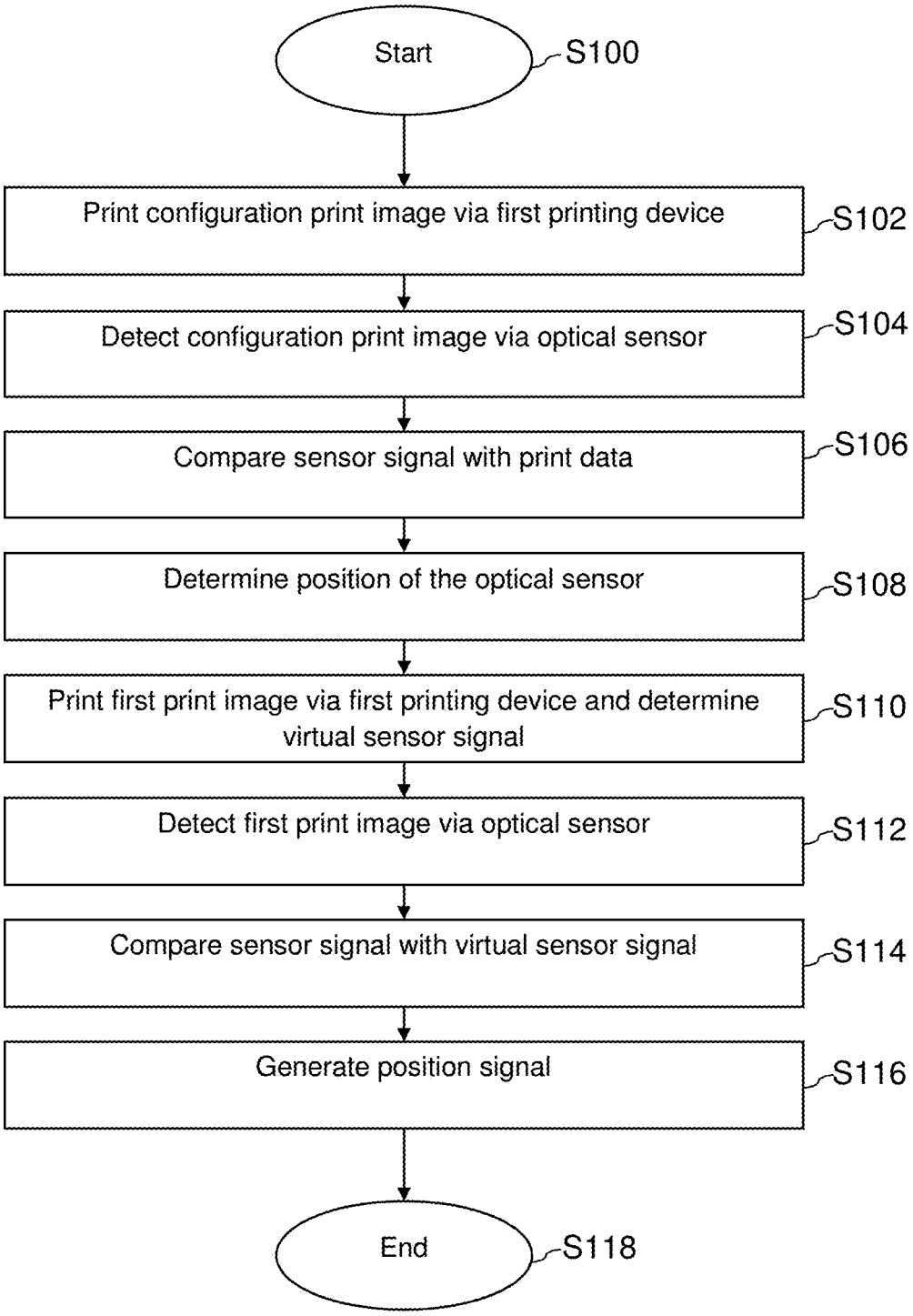
FIG. 5 is a flowchart of a method for synchronizing the generation of print images on a recording medium via a plurality of printing devices according to an exemplary embodiment.

FIG. 5 shows a workflow diagram of a method for synchronizing the generation of print images 39 on a recording medium 12 with the aid of at least two printing devices 10, 42. For this purpose, the optical sensor 48 detects a property of the print image 39 printed by the first printing device 10.

The workflow starts in step S100. In step S102, the configuration print image 50 is subsequently printed by the first printing device 10 onto the recording medium 12, and in step S104 said print image 50 is subsequently detected with the aid of the optical sensor 48. The sensor 40 thereby detects the brightness of the configuration print image 50 along a track 58 to 62, wherein the sensor generates a curve of the sensor signal 72 to 76 and transmits said curve to the controller 44.

In step S106, based on the print data for printing the configuration print image 50, the controller 44 checks at which position transverse to the printing direction T1 a virtual sensor signal would have the same curve as the curve of the sensor signal 72 to 76 as generated by the sensor.

Based on the determined position of the virtual sensor signal in the configuration print image 50, in step S108 the position of the optical sensor 48 transverse to the printing direction T1 is then determined and stored as a position of the optical sensor 48 in the controller 44.

In step S110, a first print image 39 is then printed by the first printing device 10 onto the recording medium 12. Moreover, an additional virtual sensor signal is determined from the print data of the first print image 39. This virtual sensor signal is determined from the position of the optical sensor 48, determined in step S108, and the corresponding track 58 to 62 of the optical sensor 48. The virtual sensor signal is determined from the curve of the brightness values of the print data of a region of the first print image 39 corresponding to the track 58 to 62 of the optical sensor 48.

In step S112, the first print image 39 is subsequently detected with the aid of the optical sensor 48, wherein the sensor generates a curve of the sensor signal 72 to 76 and transmits said curve to the controller 44.

In step S114, the curve of the sensor signal determined in step S112 is compared with the curve of the virtual sensor signal from step S110.

Given an agreement of the curve of the virtual sensor signal and the actual sensor signal determined with the aid of the optical sensor, a position signal is generated in step S116. Depending on the position signal and the length of the recording medium 12 between the optical sensor 48 and the second printing device 42, the printing of a second print image 45 onto the recording medium 12 with the aid of said second printing device 42 is started.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

10 first printing device (first printer)
12 recording medium
14 to 22 print bars
24, 26 infeed rollers
28 to 38 guide rollers
39 first print image
40 outfeed roller
42 second printing device (second printer)
44 controller
45 second print image
46 turner
48 optical sensor
50 configuration print image
52, 54 print objects of the configuration print image
56 axis of symmetry
58 to 62 track of the optical sensor
64 to 70 sides of the print objects
72 to 76 curve of the sensor signal
L length of the recording medium
T1 transport direction, printing direction

The invention claimed is:

1. A method for synchronizing a first printing device with a second component based on a property of a print image printed by the first printing device, the property being detected by an optical sensor, the method comprising:

printing, based on first print data, a first print image onto a recording medium using the first printing device;

determining a virtual sensor signal based on the first print data and a known position of the optical sensor transverse to a printing direction;

detecting, using the optical sensor, at least one part of the first print image to detect a property of the first print image and generate a corresponding sensor signal;

comparing a curve of the sensor signal with a curve of the virtual sensor signal to generate a position signal based on the comparison; and activating the second component, which is arranged downstream in the printing direction, based on the position signal.

2. The method according to claim 1, wherein the second component is a second printing device, the activation of the second component including starting printing of a second print image by the second printing device based on the position signal.

3. The method according to claim 1, wherein at least one part of a configuration print image printed onto the recording medium by the first printing device is detected using the optical sensor, wherein the optical sensor is configured to detect a property of the configuration print image and generate a corresponding sensor signal.

4. The method according to claim 3, further comprising:

generating a configuration curve of the sensor signal based on a detection of the configuration print image; and comparing the configuration curve with the curve of the virtual sensor signal to determine a position of the optical sensor transverse to the printing direction.

5. The method according to claim 3, wherein the property of the first print image and the property of the configuration print image are optical properties of the first print image and the configuration print image.

6. The method according to claim 5, wherein the optical properties are brightness and/or color of the first print image and configuration print image, a curve of the brightness and/or a curve of the color over a region of the recording medium in the printing direction being detected as a sensor signal by the optical sensor.

7. The method according to claim 3, wherein:

the configuration print image comprises at least one print object that is printed over an entire printable width of the recording medium in a primary color or a mixed color of the first printing device, and the at least one print object is a geometric shape bounded by at least three sides, the geometric shape having a first side orthogonal to the printing direction over the printable width of the recording medium, a second side at an angle transversely over the printable width of the recording medium, and a third side that is parallel to the printing direction at an edge of the printable area of the recording medium.

8. The method according to claim 3, wherein, upon detection of the configuration print image, an extent of the print object in the printing direction is determined using the optical sensor, and wherein the extent of the print object is determined by at least two changes in the property of the configuration print image.

9. The method according to claim 8, wherein the extent of the print object is determined by changing the detected property on the first side and the second side of the print object.

10. The method according to claim 1, wherein the virtual sensor signal is generated based on the curve of the property of the first print image at the position of the optical sensor, the curve of the property of the first print image being based on the first print data.

11. The method according to claim 1, wherein the optical sensor is arranged between the first printing device and the second component, a length of the recording medium between the optical sensor and the second component being known.

12. The method according to claim 1, wherein a position of the optical sensor transverse to the printing direction is measured and stored in a controller of the first printing device.

13. The method according to claim 1, wherein the second component is a post-processor and/or an image recognition system (ILS).

14. A non-transitory computer-readable storage medium with an executable program stored thereon, wherein, when executed, the program instructs a processor to perform the method of claim 1.

15. A device for synchronizing a first printing device with a second component, comprising:

an optical sensor configured to detect at least one part of a print image generated on a recording medium to detect a property of at least one part of the print image and generate a corresponding sensor signal, the optical sensor being arranged downstream of the first printing direction and before the second component, in a transport direction of the recording medium; and a controller configured to:

control the first printing device and second component such that the first printing device prints the print image onto the recording medium based on print data, determine a virtual sensor signal based on the print data and a known position of the optical sensor transverse to the printing direction, compare a curve of the sensor signal with a curve of the virtual sensor signal to generate a position signal based on the comparison, and activate the second component based on the position signal.

* * * * *